US011186090B2

(12) United States Patent
Chen et al.

(10) Patent No.: US 11,186,090 B2
(45) Date of Patent: Nov. 30, 2021

(54) FLUID EJECTION DEVICE

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US); Erik D Torniainen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/320,933

(22) PCT Filed: Nov. 1, 2016

(86) PCT No.: PCT/US2016/059869

§ 371 (c)(1),
(2) Date: Jan. 25, 2019

(87) PCT Pub. No.: WO2018/084827

PCT Pub. Date: May 11, 2018

(65) Prior Publication Data

US 2019/0248141 A1 Aug. 15, 2019

(51) Int. Cl.
*B41J 2/14* (2006.01)
*B41J 2/16* (2006.01)

(52) U.S. Cl.
CPC ..... *B41J 2/1634* (2013.01); *B41J 2/14072* (2013.01); *B41J 2/14201* (2013.01);
(Continued)

(58) Field of Classification Search
CPC ..... B41J 2/14072; B41J 2202/19
See application file for complete search history.

(56) References Cited

U.S. PATENT DOCUMENTS 6,505,913 B2 1/2003 Silverbrook
6,648,437 B2 * 11/2003 Kawamura ..... B41J 2/14024 347/58

(Continued)

FOREIGN PATENT DOCUMENTS

CN 101209619 7/2008
CN 10512771 A 12/2015

(Continued)

OTHER PUBLICATIONS

Steinert, C.P., et al. Jan. 30-Feb. 3, 2005, < http://ieeexplore.IEEE.org/xpls/abs_all.jsp?arnumber=1453989&tag=1 >.

*Primary Examiner* — Shelby L Fidler
(74) *Attorney, Agent, or Firm* — Law Offices of Michael Dryja

(57) ABSTRACT

Examples include a fluid ejection die embedded in a molded panel. The fluid ejection die comprises a substrate, and the substrate includes an army of nozzles extending therethrough. The substrate has a first surface in which nozzle orifices are formed and a second surface, opposite the first surface, in which nozzle inlet openings are formed. The fluid ejection die is embedded in the molded panel such that the first surface of the substrate is approximately planar with a top surface of the molded panel. The molded panel has a fluid channel formed therethrough in fluid communication with the nozzle inlet openings of the array of nozzles.

19 Claims, 8 Drawing Sheets

(52) U.S. Cl.
CPC ..... *B41J 2/1601* (2013.01); *B41J 2/1607* (2013.01); *B41J 2/1632* (2013.01); *B41J 2/1637* (2013.01); *B41J 2002/14491* (2013.01); *B41J 2202/18* (2013.01)

(56) References Cited

U.S. PATENT DOCUMENTS

| | | | | |
|---|---|---|---|---|
| 8,063,318 | B2 | 11/2011 | Williams et al. | |
| 8,438,730 | B2 | 5/2013 | Ciminelli | |
| 8,496,317 | B2 | 7/2013 | Ciminelli et al. | |
| 2002/0001020 | A1* | 1/2002 | Mrvos | B41J 2/14072 347/65 |
| 2003/0193545 | A1* | 10/2003 | Boucher | B41J 2/14072 347/50 |
| 2004/0095419 | A1 | 5/2004 | Silverbrook | |
| 2007/0216234 | A1 | 9/2007 | Brother | |
| 2011/0267404 | A1* | 11/2011 | Lebens | B41J 2/1603 347/47 |
| 2015/0004756 | A1 | 1/2015 | Chi et al. | |
| 2016/0001551 | A1 | 1/2016 | Chen et al. | |
| 2016/0009086 | A1 | 1/2016 | Choy et al. | |
| 2016/0236930 | A1 | 8/2016 | North et al. | |

FOREIGN PATENT DOCUMENTS

| | | | | |
|---|---|---|---|---|
| CN | 105121167 | | 12/2015 | |
| EP | 1473161 | A1 * | 11/2004 | B41J 2/14024 |
| RU | 1635896 | A3 | 3/1991 | |
| WO | WO-2014133517 | | 9/2014 | |
| WO | WO-2014133575 | A1 * | 9/2014 | B41J 2/1603 |
| WO | WO-2014133600 | A1 * | 9/2014 | B41J 2/155 |
| WO | WO-2015041665 | | 3/2016 | |
| WO | WO-WO2016137490 | A1 | 9/2016 | |

* cited by examiner

FLUID EJECTION DEVICE

BACKGROUND

Printers are devices that deposit a fluid, such as ink, on a print medium, such as paper. A printer may include a printhead that is connected to a printing material reservoir. The printing material may be expelled, dispensed, and/or ejected from the printhead onto a physical medium.

DRAWINGS

Figure 1:
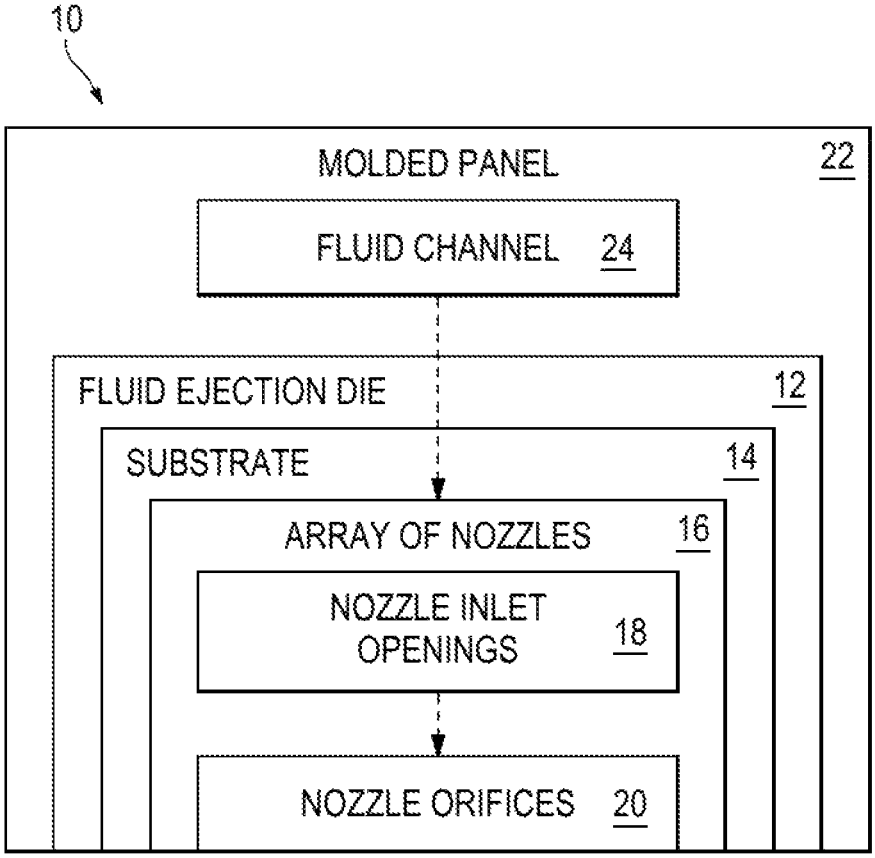
FIG. 1 is a block diagram of some components of an example fluid ejection device.

FIGS. 8A-E are block diagrams of an example fluid ejection device and example operations of a corresponding process.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DESCRIPTION

Examples of fluid ejection devices may comprise at least one fluid ejection die comprising a substrate. The substrate may include an array of nozzles formed therethrough. Accordingly, nozzle orifices of the nozzles may be formed on a first surface of the substrate. Nozzle inlet openings of the nozzles may be formed on a second surface of the substrate, where the second surface is opposite the first surface. Furthermore, example fluid ejection devices may comprise a molded panel in which the at least one fluid ejection die may be embedded therein. In such examples, the first surface of the substrate of the fluid ejection die may be exposed such that the first surface of the substrate of the fluid ejection die is approximately planar with a top surface of the molded panel. Approximately planar may refer to a plane of the first surface of the fluid ejection die and a plane of the top surface of the molded panel being generally parallel, where "approximately" and "generally" may refer to the surfaces having angles of orientation therebetween within a range of 0° to 10°.

Accordingly, as used herein, the fluid ejection die embedded in the molded panel may describe the arrangement of the fluid ejection die such that side surfaces of the fluid ejection die and the second surface of the fluid ejection die may be at least partially enclosed by the molded panel. In addition, the at least one fluid ejection die may be described as molded into the molded panel. Furthermore, the molded panel may include a fluid channel formed therethrough, where the fluid channel may be in fluid communication with the nozzle inlet openings of the array of nozzles of the fluid ejection die. In some examples, the fluid channel may be referred to as a fluid slot and/or a fluid communication channel.

Nozzles may facilitate ejection/dispensation of fluid. Fluid ejection devices may comprise fluid ejection actuators disposed proximate to the nozzles to cause fluid to be ejected/dispensed from a nozzle orifice. Some examples of types of fluid ejectors implemented in fluid ejection devices include thermal ejectors, piezoelectric ejectors, and/or other such ejectors that may cause fluid to eject/be dispensed from a nozzle orifice. In some examples the substrate of the fluid ejection die may be formed with silicon or a silicon-based material. Various features, such as nozzles, may be formed by etching and/or other such microfabrication processes. In examples described herein, fluid ejection actuators may be disposed on the second surface of the substrate, and at least one fluid ejection actuator may be positioned proximate each nozzle inlet opening.

In some examples, fluid ejection dies may be referred to as slivers. Generally, a sliver may correspond to an ejection die having: a thickness of approximately 650 μm or less; exterior dimensions of approximately 30 mm or less; and/or a length to width ratio of approximately 3 to 1 or larger. In some examples, a length to width ratio of a sliver may be approximately 10 to 1 or larger. In some examples, a length to width ratio of a sliver may be approximately 50 to 1 or larger. In some examples, fluid ejection dies may be a non-rectangular shape. In these examples a first portion of the ejection die may have dimensions/features approximating the examples described above, and a second portion of the fluid ejection die may be greater in width and less in length than the first portion. In some examples, a width of the second portion may be approximately 2 times the size of the width of the first portion. In these examples, a fluid ejection die may have an elongate first portion along which ejection nozzles may be arranged.

In some examples, the molded panel may comprise an epoxy mold compound, such as CEL400ZHF40WG from Hitachi Chemical, Inc., and/or other such materials. Accordingly, in some examples, the molded panel may be substantially uniform. In some examples, the molded panel may be formed of a single piece, such that the molded panel may comprise a mold material without joints or seams. In some examples, the molded panel may be monolithic.

Example fluid ejection devices, as described herein, may be implemented in printing devices, such as two-dimensional printers and/or three-dimensional printers (3D). As will be appreciated, some example fluid ejection devices may be printheads. In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

Turning now to the figures, and particularly to FIG. 1, this figure provides block diagram of some components of an example fluid ejection device 10. The example fluid ejection device 10 comprises a fluid ejection die 12 that includes a substrate 14, where the substrate 14 includes an array of nozzles 16 formed therethrough. Each nozzle 16 includes a nozzle inlet opening 18 and a nozzle orifice 20. The nozzle orifices 20 are formed in a first surface of the substrate 14, and the nozzle inlet openings 18 are formed in a second surface of the substrate 14. Furthermore, the example device 10 comprises a molded panel 22 having a fluid channel 24 formed therethrough, and the fluid channel 24 is fluidly connected to the array of nozzles 16 such that fluid may be conveyed to the nozzles 16 via the fluid channel 24.

Figure 2:
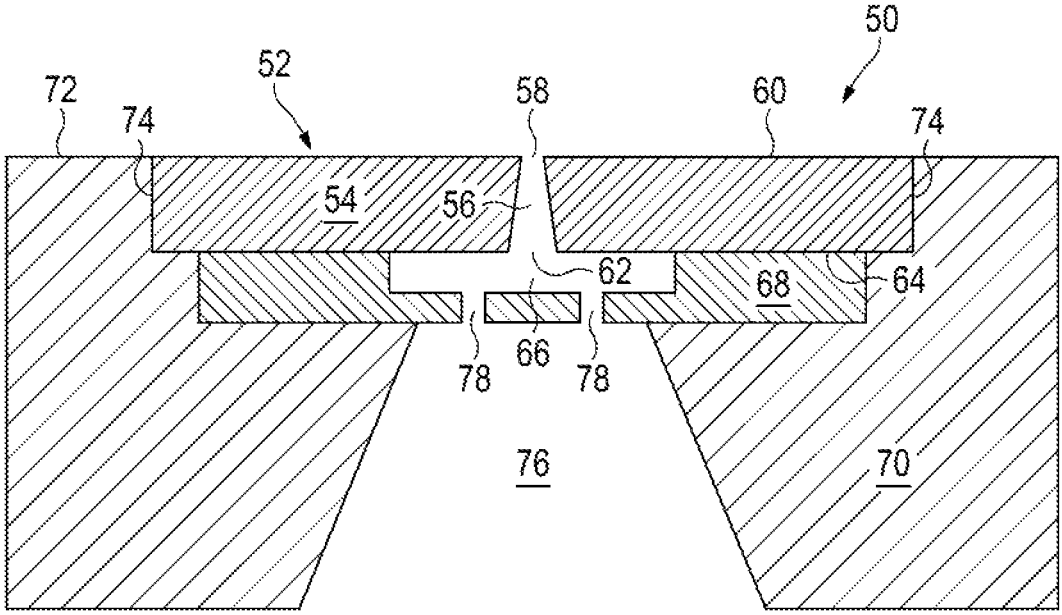
FIG. 2 is a side view of some components of an example fluid ejection device.

FIG. 2 provides a side view of some components of an example fluid ejection device 50. As shown in this example, the fluid ejection device 50 comprises a fluid ejection die 52 that includes a substrate 54. The substrate 54 includes a nozzle 56 formed therethrough. Accordingly, the substrate 54 includes a nozzle orifice 58 of the nozzle 56 formed in a first surface 60 of the substrate 54. The substrate 54 includes a nozzle inlet opening 62 formed in a second surface 64 of the substrate 54. Proximate to, and fluidly connected to the nozzle 56, the fluid ejection die 52 includes an ejection chamber 66 formed in a thin film layer 68. In some examples, the thin film layer 68 may be formed with a polymer material. Examples of such polymer materials, including, for example, SU-8 epoxy-based material from Microchem, Cydotene from Dow Chemical, TMMF from TOK, dielectric, polyimide, metal, etc. As shown, the thin film layer 68 is adjacent the second surface 64 of the substrate 54.

In the example of FIG. 2, the fluid ejection device 50 further comprises a molded panel 70. As shown, the fluid ejection die 52 is embedded in the molded panel 70 such that the first surface 60 of the substrate 54 is approximately planar with a top surface 72 of the molded panel 70. As shown, side surfaces 74 and at least a portion of the second surface 64 are covered by the molded panel 70. Furthermore, the molded panel 70 includes a fluid channel 76 formed therethrough and fluidly connected to the ejection chamber 66 and nozzle 56. In this example, the fluid channel 76 is fluidly connected to the ejection chamber 66 via fluid feed holes 78 formed through the chamber layer 68.

Figure 3:
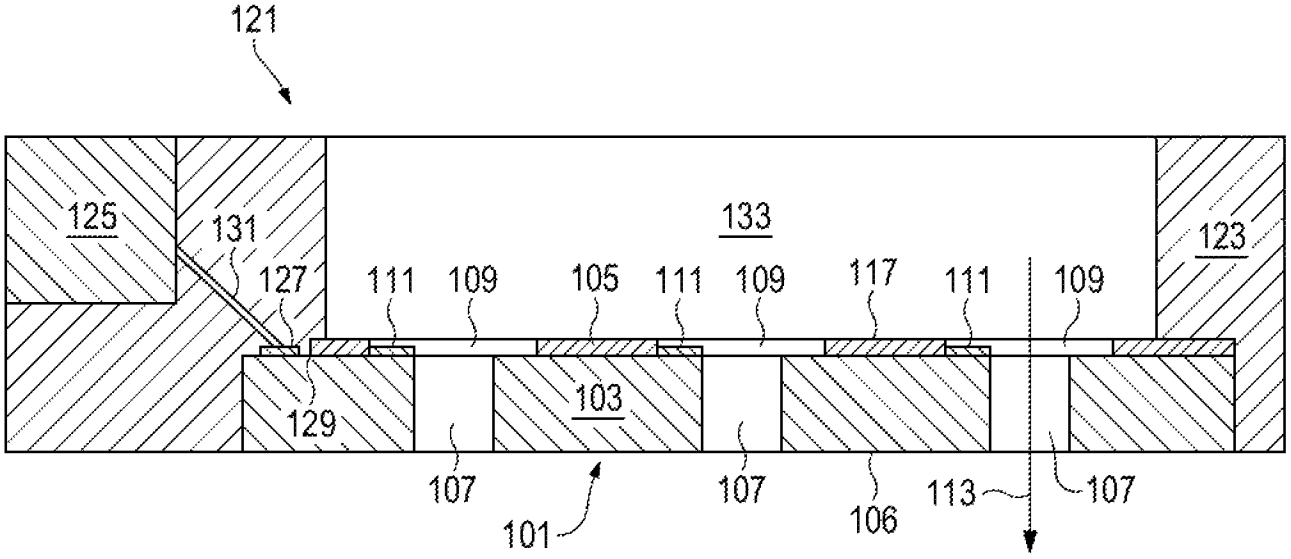
FIG. 3 is a side view of some components of an example fluid ejection device.

Turning now to FIG. 3, this figure illustrates a diagram of an example of a fluid ejection device 121 including a fluid ejection die 101. The fluid ejection die 101 may include all features discussed with reference to the examples of FIGS. 1-2. In this example, the die 101 includes nozzles 107 formed through a substrate 103 thereof. The die 101 further includes thin film layers 105 in which ejection chambers 109 may be formed. Furthermore, the thin film layers 105 include at least one fluid ejection actuator 111 disposed proximate each nozzle 107 on a second surface 117 of the substrate 103, where the second surface 117 of the substrate 103 is opposite a first surface 106 of the substrate 103.

In the example of FIG. 3, the die 101 is supported by, or embedded in, a molded panel 123. The molded panel 123 embeds or supports a circuit assembly 125. In some examples, the circuit assembly 125 may comprise an application specific integrated circuit (ASIC) or other such control circuitry that may be drive circuitry for the die 101. In other examples, the circuit assembly 125 may be a circuit interposer to facilitate electrical interface routing between the die 101 and an externally connected controller. The die 101 includes at least one electrical connection point 127 on the second surface 117 of its substrate 103. This electrical connection point 127 may be electrically connected to the circuit assembly 125, from the second surface 117 to the circuit assembly 125 by a conducting element 131. In such examples, the conducting element 131 may be encased in and electrically insulated by the molded panel 123. Accordingly, electrical interconnections may be fully shielded by the substrate 103 and/or molded panel 123. Furthermore, the die 101 includes thin film layers 105, for example near an edge 129 of the substrate 103. In another example the electrical contact point 127 may be disposed on the thin film layers 105, for example near the edge of the thin film layers 105 and/or substrate 103. In some examples the die 101, conductive element 131, and/or circuit assembly 125 may be directly overmolded in the molded panel 123.

The molded panel 123 may further comprise a fluid channel 133 to supply fluid to fluid channels and/or ejection chambers 109 of the thin film layers 105. Actuators 111 in the chambers 109 may eject the supplied fluid through nozzles 107 in the substrate 103. The thin film layers 105 extend between the molded panel 123 and the substrate 103, and/or between the fluid channel 133 and the substrate 103, so that in use fluid flows from the molded panel 123 to the thin film layers 105, engaging first packaging walls 123 and subsequently thin film layer walls such as chamber or channel walls. The fluid flows from the thin film layers 105, out of the ejection chambers 109, through the substrate 103, as indicated with fluid flow direction arrow 113. Nozzles 107 are provided through the substrate 103, fluidically connected to the chambers 109, to eject the fluid out through the nozzles 107 by actuation of the actuators 111. Actuation of the actuators 111 may be driven by drive circuitry of the circuit assembly 125, drive circuitry in the thin film layers 105, and/or an external controller connected via the circuit assembly 125.

Figure 4:
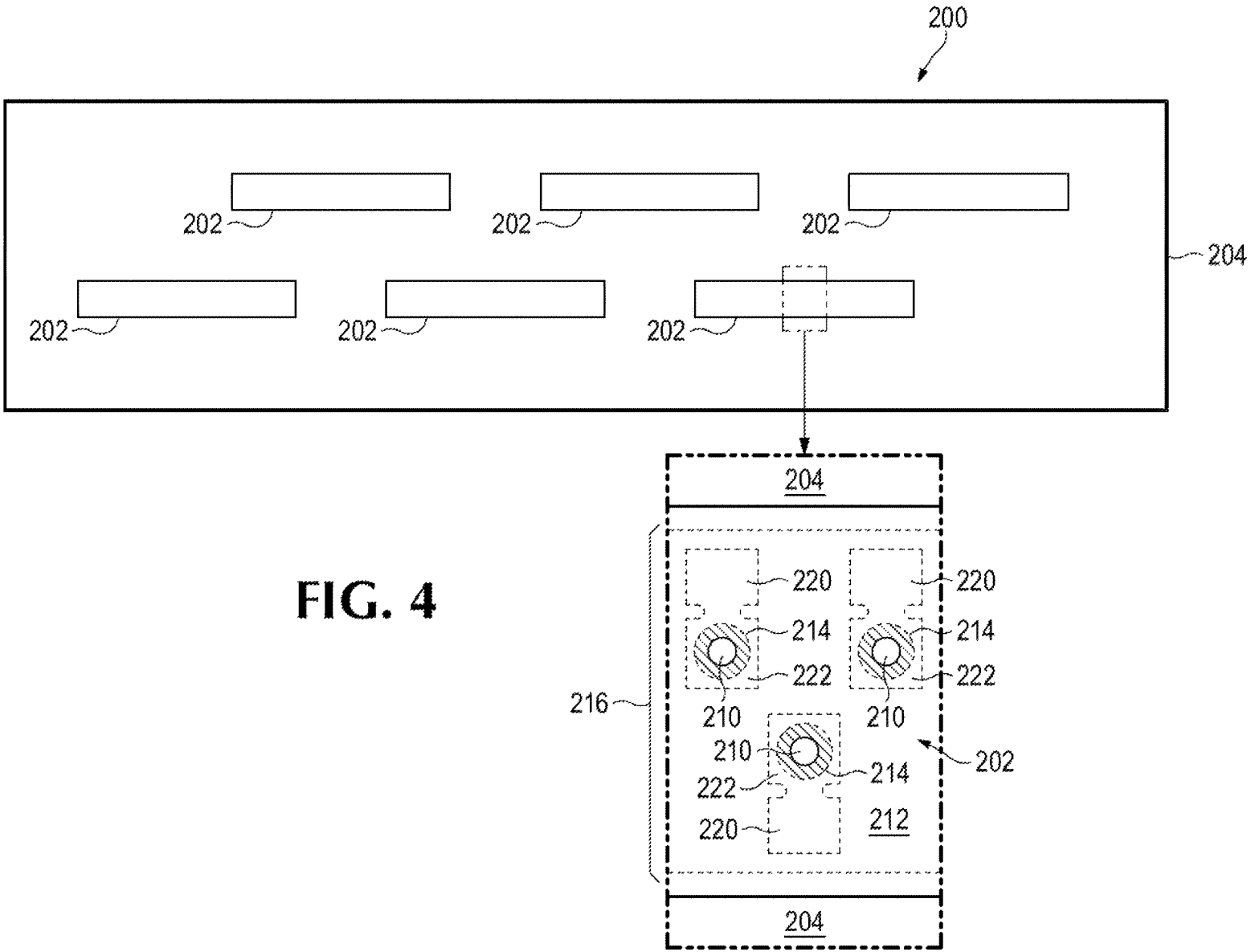
FIG. 4 is top view of some components of an example fluid ejection device.

FIG. 4 provides a top view of some components of an example fluid ejection device 200. In this example, the fluid ejection device 200 comprises a plurality of fluid ejection dies 202 embedded in a molded panel 204. In this example, the fluid ejection dies 202 are arranged generally end-to-end along a width of the molded panel 204. Furthermore, the fluid ejection dies 202 are arranged in a staggered manner to facilitate overlap of some nozzles of neighboring fluid ejection dies 202. As provided in the detail view of FIG. 4, each fluid ejection die 202 comprises nozzles 210 formed through a substrate 212 of the fluid ejection die 202. It will be appreciated that the view of FIG. 4 provides a first surface of each fluid ejection die 202 and the top surface of the molded panel 204. Accordingly, in the provided detail view, the nozzle orifices of the nozzles 210 are visible. To provide further detail, a fluid ejection actuator 214 is illustrated in cross-hatching with dashed line. It will be appreciated that the fluid ejection actuator 212 for each nozzle is disposed on a second surface of the substrate 212 that is opposite the first surface in which the nozzle orifices are formed. In addition, a fluid channel 216 is illustrated in dashed line, as the fluid channel 216 is formed through the molded panel 204 under the fluid ejection die 202. Furthermore, the detail view further includes a fluid feed hole 220 and ejection chamber 222 illustrated in dashed line for each nozzle 210. As will be appreciated, the fluid feed hole 220 and ejection chamber 222 corresponding to the nozzle 210 is disposed under the substrate 212 of the fluid ejection die 202.

Figure 5:
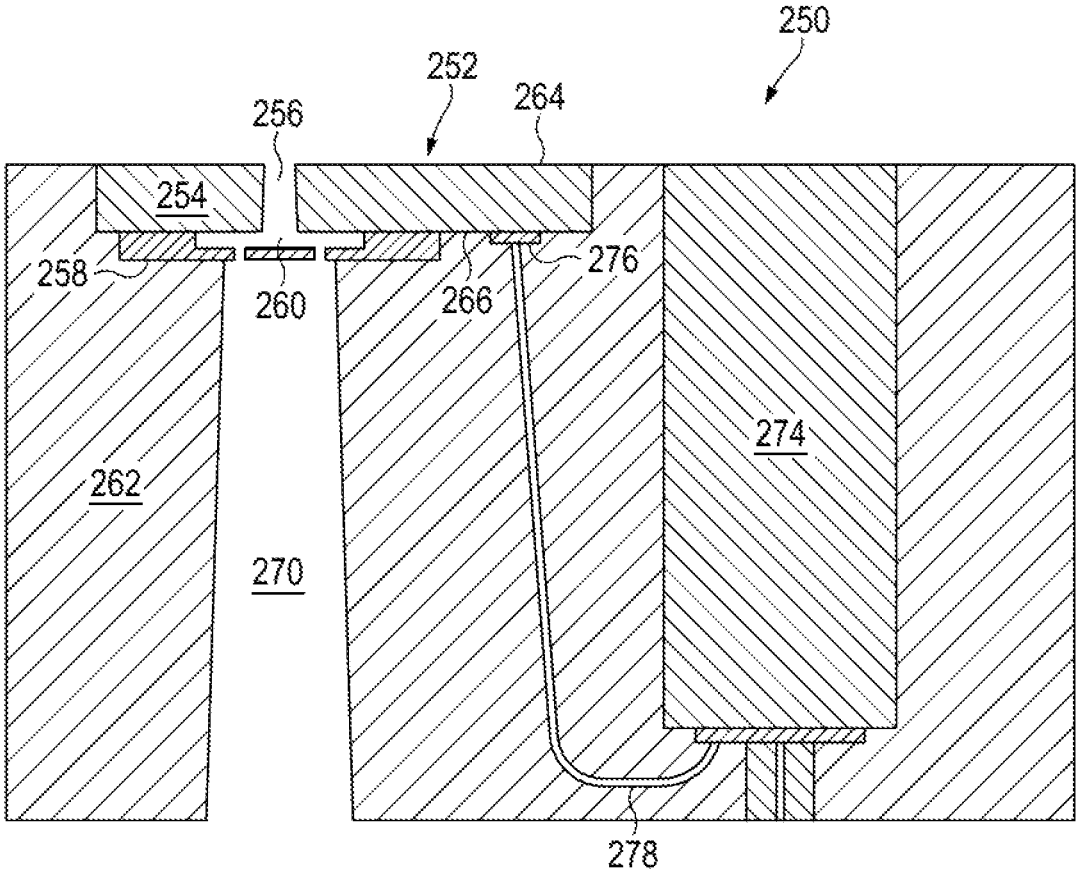
FIG. 5 is a cross-sectional view of some components of an example fluid ejection device.

FIG. 5 provides a side view of some components of an example fluid ejection device 250. In this example, the fluid ejection device 250 comprises a fluid ejection die 252. The fluid ejection die comprises a substrate 254 that includes at least one nozzle 256 formed therethrough as described in previous examples. In addition, the die 252 includes at least one thin film layer 258 in which an ejection chamber 260 may be formed. The fluid ejection die 252 is embedded in a molded panel 262, such that a first surface 264 (i.e., a top surface) of the substrate 254 is uncovered by the molded panel 262 and a second surface 266 (i.e., a bottom surface) is at least partially covered by the molded panel 262. As described in other examples, the molded panel 262 includes a fluid channel 270 formed therethrough and fluidly connected to the ejection chamber 260 and nozzle 256.

In the example of FIG. 5, the fluid ejection device 250 further includes a circuit assembly 274 at least partially embedded in the molded panel 262. In this example, the circuit assembly 274 corresponds to a circuit interposer. As shown, the circuit assembly 274 is electrically connected to an electrical connection point 276 of the fluid ejection die 252 via a conductive element 278. As discussed previously, the conductive element 278 passes through and is encased in the molded panel 262. While not shown in this example, the circuit assembly 274 may be connected to a controller such that the fluid ejection die 252 may be electrically connected to such controller via the circuit assembly 274.

Figure 6:
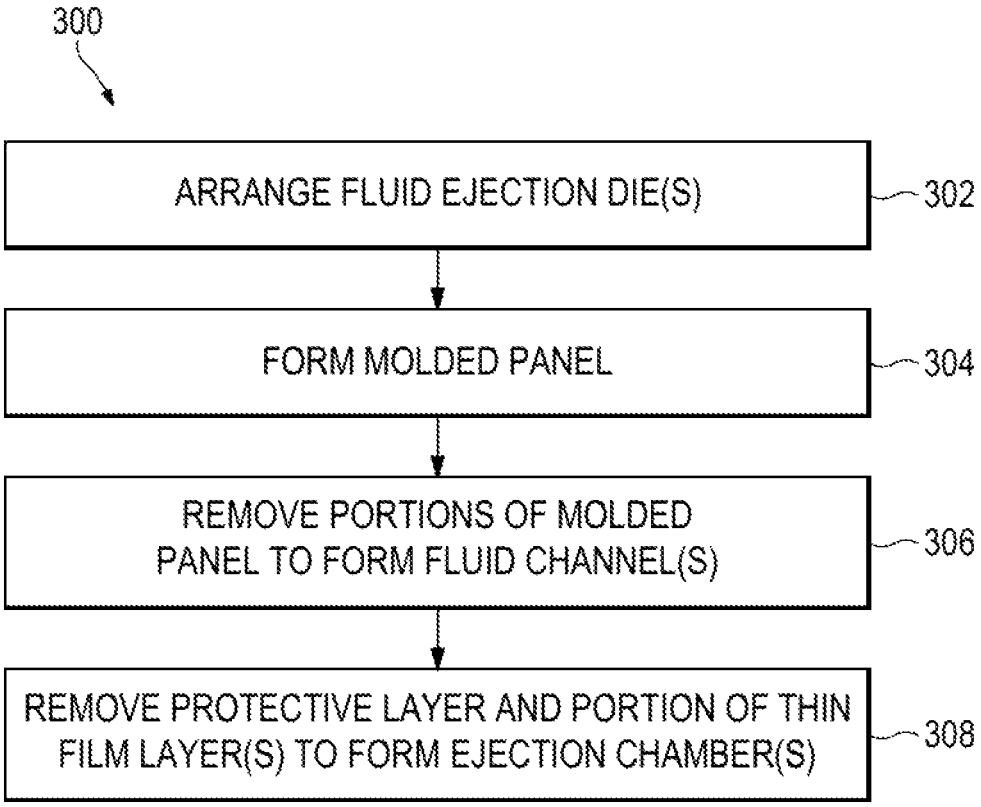
FIG. 6 is a flowchart of an example process.
Figure 7:
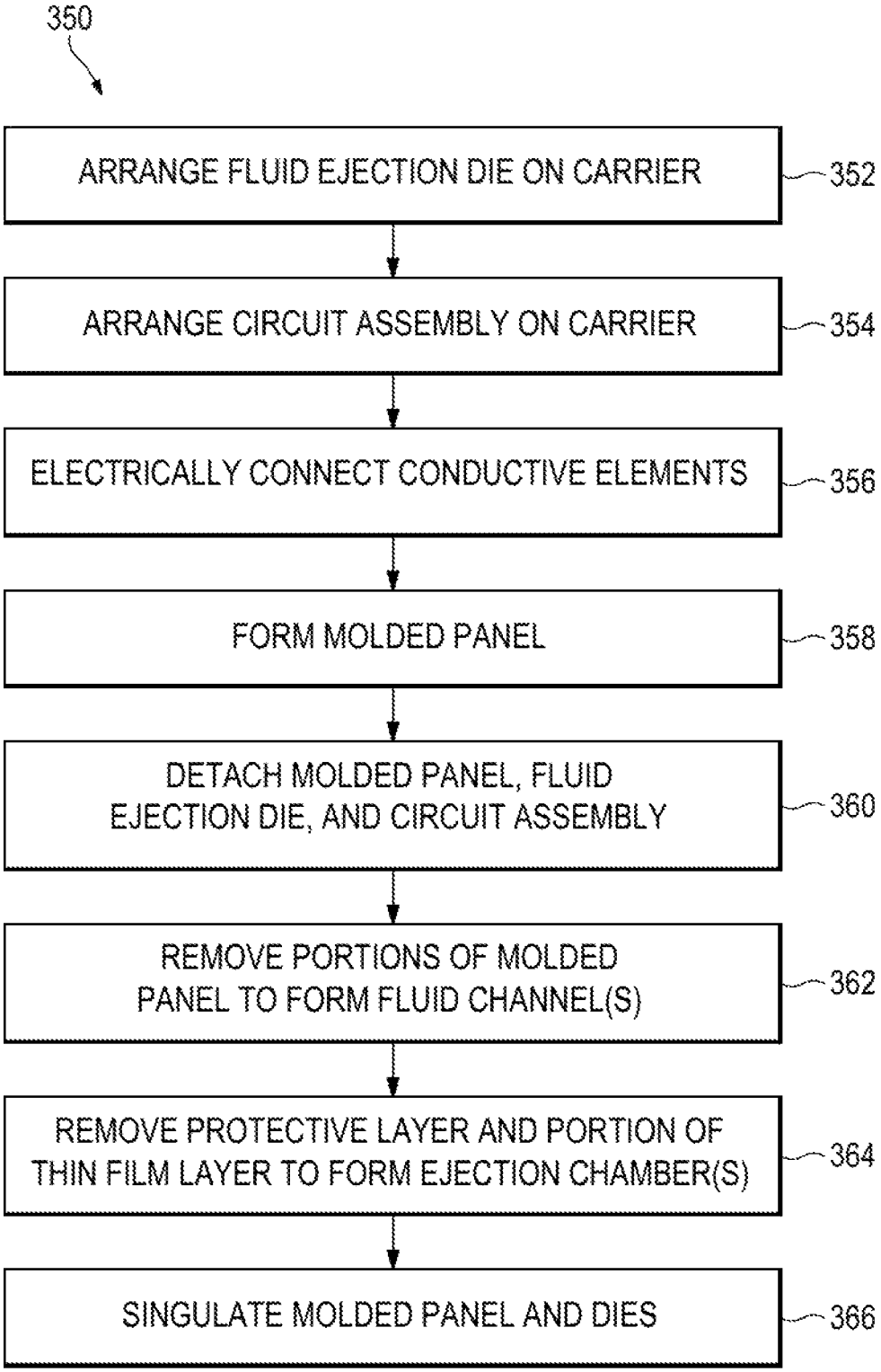
FIG. 7 is a flowchart of an example process.

FIGS. 6-7 provide flowcharts that illustrate operations of example processes for forming example fluid ejection devices as described herein. FIGS. 8A-E provide block diagrams that correspond to example process operations that may be performed to thereby form an example fluid ejection die.

Turning to FIG. 6, this figure provides a flowchart 300 that illustrates a sequence of operations corresponding to a process to form example fluid ejection devices. As shown in FIG. 6, a plurality of fluid ejection dies may be arranged (block 302), where each fluid ejection die may include a substrate having an array of nozzles formed therethrough, where nozzle orifices may be formed in a first surface of the substrate and nozzle inlet openings may be formed in a second surface of the substrate. Furthermore, each fluid ejection die may include a protective layer disposed on the second surface of the ejection die and extending though the nozzles of the ejection die. In addition, each fluid ejection die includes at least one thin film layer disposed on the second surface of the substrate. With a mold material, a molded panel may be formed that includes the fluid ejection dies (block 304). In some examples, a molded panel may formed by compression molding, transfer molding, or other such exposed die molding processes.

Portions of the molded panel may be removed to thereby form fluid channels in the molded panel (block 306). In some examples, a fluid channel may be formed for each fluid ejection die. In other examples, a fluid channel may be formed for more than one fluid ejection die. In some examples, removing a portion of the molded panel may comprise slot-plunge cutting the portion of the molded panel. In other examples, removing a portion of the molded panel may comprise cutting the molded panel with a laser or other cutting device. Furthermore, removing a portion of the molded panel may comprise performing other micromachining processes.

The protective layer and at least one thin film layer of each fluid ejection die may be removed to thereby form an ejection chamber for each nozzle of each fluid ejection die (block 308). In some examples, removing the protective layer may comprise wet dipping in feature formation material remover. For example, if the feature formation material is HT10.10, the molded panel may be wet dipped in Wafer-Bond remover from Brewer Science, Inc. In some examples, removing a portion of the at least one thin film layer may comprise etching the at least a portion of the at least one thin film. In some examples, removing a portion of the at least one thin film layer may comprise removing the at least a portion of the at least one thin film layer mechanically, such as by saw, laser ablation, powder blast, etc.

Turning now to FIG. 7, this figure provides a flowchart 350 that illustrates an example sequence of operations that correspond to a process to form example fluid ejection devices. FIGS. 8A-E provide flow diagrams that correspond to some of the operations of FIG. 7.

Figure 8A:
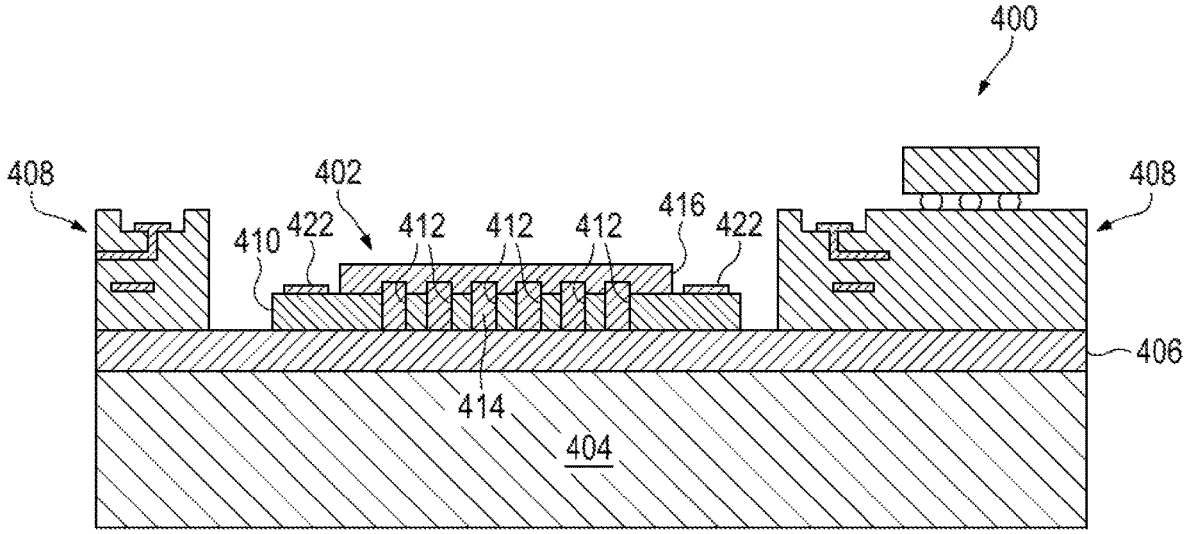

Referring to FIG. 7, a fluid ejection die may be arranged on a carrier (block 352), and a circuit assembly may be arranged on a carrier (block 354). As shown in FIG. 8A, a fluid ejection die 402 may be releasably coupled to a carrier 404 with a temporary adhesive element 406. In some examples, the temporary adhesive element 406 may be a thermal release tape or other similar temporary adhesive material. Furthermore, a circuit assembly 408 may be arranged on the carrier 404 proximate the fluid ejection die 402. As will be appreciated, the positioning of the fluid ejection die 402 and the circuit assembly 408 on the carrier 404 may correspond to a position of the fluid ejection die 402 and circuit assembly 408 in the fluid ejection device to be formed. As discussed in other examples, the fluid ejection die 402 includes a substrate 410 having an array of nozzles 412 formed therethrough. The fluid ejection die 402 further comprises a protective layer 414 disposed on the substrate and extending through the nozzles 412, and the die 402 further includes at least one thin film layer 416 disposed on the substrate 410 over the protective layer 414.

Figure 8B:
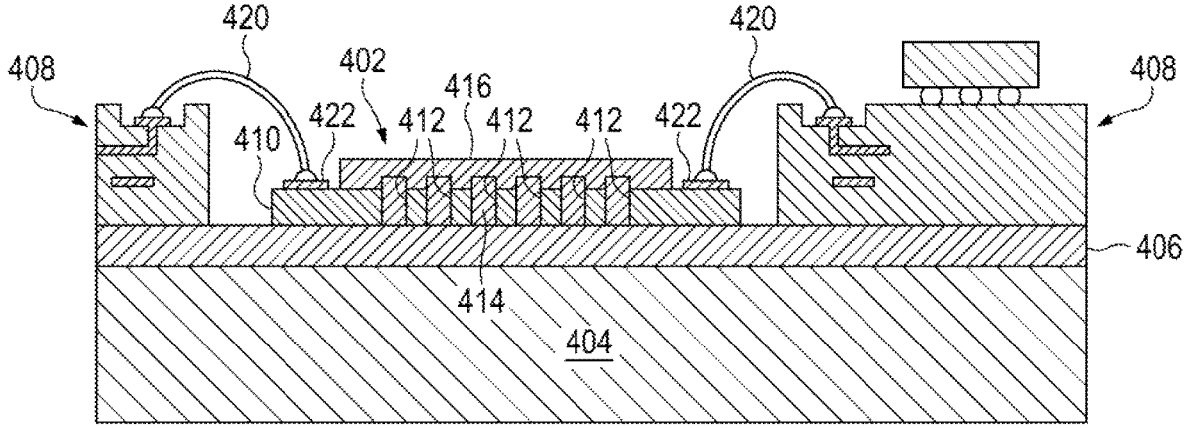
Figure 8C:
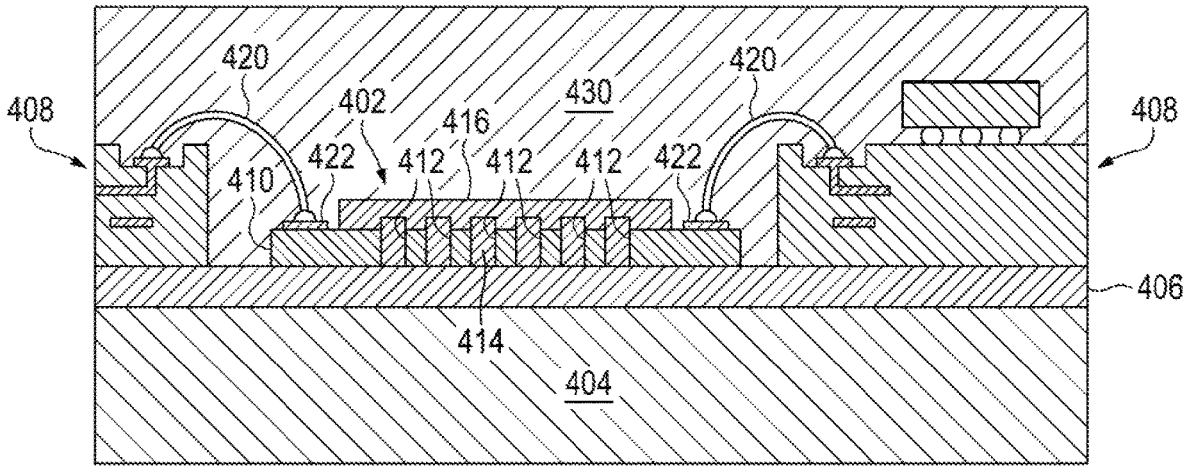
Figure 8D:
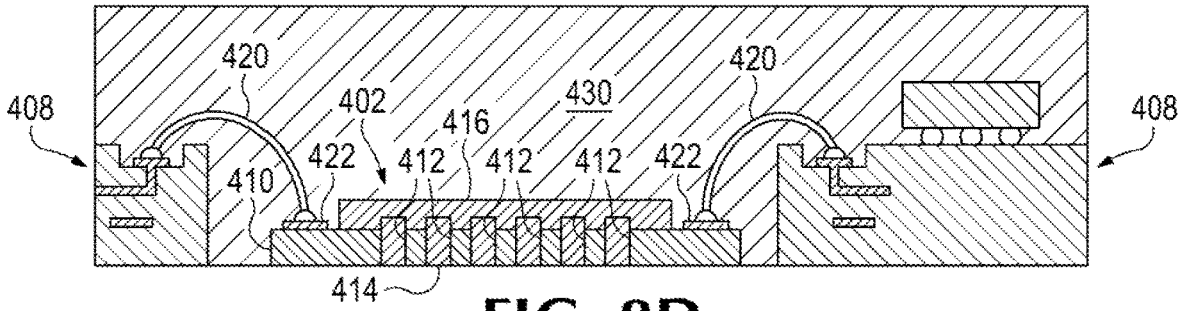

Referring to FIG. 7 and FIG. 8B, conductive elements 420 may be electrically connected (block 356) between the circuit assembly 408 and the fluid ejection die 402 with electrical contact points 422 of the fluid ejection die 402. As illustrated in FIG. 8C, a molded panel 430 may be formed (block 358) over the ejection die 402, circuit assembly 408, and conductive elements 420. In FIG. 8D, the molded panel 430 that includes the fluid ejection die 402 and circuit assembly 408 embedded therein are detached from the carrier (block 360).

Figure 8E:
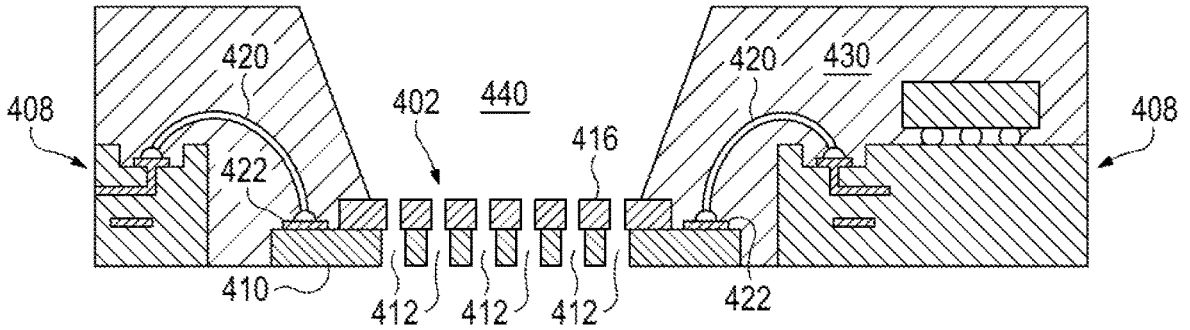

To form the example fluid ejection device in FIG. 8E, portions of the molded panel may be removed to form a fluid channel (block 362), and the protective layer and at least a portion of the at least one thin film layer may be removed to form ejection chambers for the nozzles (block 364). In examples, the molded panel and fluid ejection dies may be singulated (block 366) such that a plurality of fluid ejection devices may be separated. Singulating the devices may comprise dicing the molded panel, cutting the molded panel, and/or other such known singulation processes.

Accordingly, examples provided herein may implement a fluid ejection device comprising at least one fluid ejection die embedded in a molded panel. As discussed, the fluid ejection die may comprise a substrate having nozzles formed therethrough, and the fluid ejection die may comprise at least one thin film layer adjacent to the substrate including fluid ejection actuators disposed proximate each nozzle and having ejection chambers for the nozzles formed therein. As will be appreciated, embedding of fluid ejection dies in a molded panel and forming of a fluid channel therein may facilitate reduced substrate area of the fluid ejection devices. Furthermore, formation of nozzles in the substrate, such as a silicon based substrate, may facilitate nozzle formation with microfabrication and micromachining processes.

In one example the thin film layers include (i) electrical circuitry, and (ii) electrical contacts connected to the electrical circuitry, for connection to drive circuitry external to the die. The electrical contacts can be disposed at the thin film layer side of the substrate, for example near at least one edge of the substrate to readily connect the electrical circuitry to said external drive circuitry. Furthermore, the molded panel may including at least one fluid channel to supply fluid to the ejection chambers and nozzles. For example fluid supply holes may fluidically connect the fluid channel to the ejection chambers. Thin film layers extend between at least one of (i) the molded panel and the substrate, and (ii) the fluid channel and the substrate. In a further example the external drive circuitry is provided in or on the packaging.

In some examples a depth of the nozzles is more than a thickness of the thin film layers, and the sum of that depth and thickness approximately equals the total thickness of the fluid ejection die. In some examples, the thickness of the die is less than approximately 300 micron.

While various examples are described herein, elements and/or combinations of elements may be combined and/or removed for various examples contemplated hereby. For example, the example operations provided herein in the flowcharts of FIGS. 6-7 may be performed sequentially, concurrently, or in a different order. Moreover, some example operations of the flowcharts may be added to other flowcharts, and/or some example operations may be removed from flowcharts. Furthermore, in some examples, various components of the example devices of FIGS. 1-5 may be removed, and/or other components may be added.

The preceding description has been presented to illustrate and describe examples of the principles described. This description is not intended to be exhaustive or to limit these principles to any precise form disclosed. Many modifications and variations are possible in light of the description. Therefore, the foregoing examples provided in the figures and described herein should not be construed as limiting of the scope of the disclosure, which is defined in the Claims.

The invention claimed is:

1. A fluid ejection device comprising:

a fluid ejection die comprising a substrate, the substrate including an array of nozzles extending therethrough, the substrate having a first surface in which nozzle orifices are formed, and the substrate having a second surface opposite the first surface in which nozzle inlet openings are formed; and a molded panel in which the fluid ejection die is embedded, the molded panel surrounding sides of the fluid ejection die such that the first surface of the substrate is approximately planar with a first surface of the molded panel, the molded panel having at a second surface of the molded panel a fluid channel formed therethrough in fluid communication with the nozzle inlet openings of the array of nozzles, the molded panel having a third surface between the first and second surfaces and abutting the second surface of the substrate, wherein the fluid ejection die further comprises thin film layers having a width less than a width of the substrate and having, for each respective nozzle of the array of nozzles, a respective ejection chamber at a first surface of the thin film layers abutting the second surface of the substrate and respective fluid feed holes fluidically connecting the respective ejection chamber to the fluid channel at a second surface of the thin film layers abutting the second surface of the molded panel.

2. The fluid ejection device of claim 1, wherein the thin film layers are formed on the second surface of the substrate and include fluid ejection actuators associated with the nozzles of the array of nozzles.

3. The fluid ejection device of claim 2, wherein each fluid ejection actuator is positioned proximate a respective nozzle inlet opening.

4. The fluid ejection device of claim 2, wherein the respective ejection chamber for each respective nozzle of the array of nozzles is fluidly connected to the respective nozzle and respective fluid feed holes.

5. The fluid ejection device of claim 1, further comprising:

a circuit assembly comprising an electrical connection point, the circuit assembly at least partially embedded in the molded panel; and a conductive element having a first end and a second end, the conductive element electrically connected to the fluid ejection die at the first end, the conductive element electrically connected to the electrical connection point of the circuit assembly at the second end, and the conductive element at least partially encased in the molded panel between the first end and the second end.

6. The fluid ejection device of claim 1, wherein the thin film layers comprise a polymer layer.

7. The fluid ejection device of claim 1, wherein for each respective nozzle, the respective fluid feed holes fluidically connect just the respective ejection chamber, and not the respective ejection chamber of any other respective nozzle, to the fluid channel.

8. A fluid ejection device comprising:

a plurality of fluid ejection dies, each fluid ejection die comprising a respective substrate, each respective substrate including a respective array of nozzles extending therethrough, each respective substrate having a respective first surface in which nozzle orifices are formed, each respective substrate having a respective second surface in which nozzle inlet openings are formed; and a molded panel in which the plurality of fluid ejection dies are embedded, the fluid ejection dies arranged end-to-end along a width of the molded panel, the plurality of fluid ejection dies embedded in the molded panel such that the respective first surface of each respective substrate is approximately planar with a first surface of the molded panel, and the molded panel having at a second surface of the molded panel a fluid channel formed therethrough in fluid communication with the nozzle inlet openings of the respective array of nozzles of each fluid ejection die, the molded panel having a third surface between the first and second surfaces and abutting the respective second surface of each respective substrate, wherein each fluid ejection die further comprises thin film layers having a width less than each respective substrate and having, for each respective nozzle of the array of nozzles, a respective ejection chamber at a first surface of the thin film layers abutting the second surface of the substrate and respective fluid feed holes directly fluidically connecting the respective ejection chamber to the fluid channel at a second surface of the thin film layers abutting the second surface of the molded panel.

9. The fluid ejection device of claim 8, wherein each fluid ejection die further comprises:

a respective fluid ejection actuator disposed on the second surface of each respective substrate of each fluid ejection die proximate each nozzle inlet opening.

10. The fluid ejection device of claim 8, wherein the respective ejection chamber for each respective nozzle of the array of nozzles of each fluid ejection device is fluidly connected to the respective nozzle respective fluid feed holes.

11. The fluid ejection device of claim 8, wherein the thin film layers comprise a polymer layer.

12. The fluid ejection device of claim 8, wherein for each respective nozzle, the respective fluid feed holes fluidically connect just the respective ejection chamber, and not the respective ejection chamber of any other respective nozzle, to the fluid channel.

13. A process comprising:

arranging a plurality of fluid ejection dies, each fluid ejection die comprising a respective substrate, each respective substrate including a respective array of nozzles extending therethrough, each respective substrate having a respective first surface in which nozzle orifices are formed, each respective substrate having a respective second surface in which nozzle inlet openings are formed, each ejection die including a protective layer disposed on the second surface and extending through each nozzle, and each ejection die comprising thin film layers having a width less than a width of each respective substrate and disposed on the second surface over the protective layer;

forming a molded panel including the plurality of ejection dies, the fluid ejection dies arranged end-to-end along a width of the molded panel, the plurality of fluid ejection dies embedded in the molded panel such that the respective first surface of each respective substrate is approximately planar with a first surface of the molded panel;

removing portions of the molded panel to form therethrough a fluid channel at a second surface of the molded panel, the fluid channel in fluid communication with the nozzle inlet openings of the respective array of nozzles of each fluid ejection die, the molded panel having a third surface between the first and second surfaces and abutting the respective second surface of each respective substrate; and removing the protective layer and a portion of the thin film layers to form, for each respective nozzle of the array of each fluid ejection die, a respective ejection chamber at a first surface of the thin film layers abutting the second surface of the substrate and respective fluid feed holes fluidically connecting the respective ejection chamber to the fluid channel at a second surface of the thin film layers abutting the second surface of the molded panel.

14. The process of claim 13, further comprising:

prior to forming the molded panel, electrically connecting at least one conductive element to each fluid ejection die.

15. The process of claim 14, further comprising:

prior to forming the molded panel, arranging a respective circuit assembly proximate each fluid ejection die; and electrically connecting the at least one conductive element to each respective circuit assembly.

16. The process of claim 13, wherein arranging the plurality of fluid ejection dies comprises removably coupling each fluid ejection die to a carrier, and the process further comprises:

prior to removing the portions of the molded panel, detaching the molded panel and fluid ejection dies from the carrier.

17. The process of claim 13, further comprising:

singulating the fluid ejection dies and molded panel to form fluid ejection devices.

18. The process of claim 13, wherein the thin film layers comprise a polymer layer.

19. The process of claim 13, wherein for each respective nozzle, the respective fluid feed holes fluidically connect just the respective ejection chamber, and not the respective ejection chamber of any other respective nozzle, to the fluid channel.

* * * * *